US007513599B2

(12) United States Patent
Wada et al.

(10) Patent No.: US 7,513,599 B2
(45) Date of Patent: Apr. 7, 2009

(54) INKJET RECORDING APPARATUS

(75) Inventors: Satoshi Wada, Machida (JP); Hiroshi Aoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/748,893

(22) Filed: May 15, 2007

(65) Prior Publication Data

US 2007/0291095 A1 Dec. 20, 2007

(30) Foreign Application Priority Data

Jun. 16, 2006 (JP) ..... 2006-167281

(51) Int. Cl.
*B41J 2/155* (2006.01)

(52) U.S. Cl. ..... 347/42; 347/13; 347/105

(58) Field of Classification Search ..... 347/13, 347/43, 49, 104, 105; 400/629, 525, 637; 474/132, 135, 137
See application file for complete search history.

(56) References Cited

U.S. PATENT DOCUMENTS 7,314,270 B2 * 1/2008 Enomoto et al. ..... 347/70
2002/0057309 A1 * 5/2002 Ikemoto et al. ..... 347/42

FOREIGN PATENT DOCUMENTS

JP 03-221709 A 9/1991
JP 07-60966 A 3/1995

* cited by examiner

*Primary Examiner*—Lamson D Nguyen
(74) *Attorney, Agent, or Firm*—Canon USA Inc IP Div

(57) ABSTRACT

An inkjet recording apparatus is provided that is capable of stably maintaining image quality by preventing the degradation in image quality due to a rotational body for holding down a recording medium. The inkjet recording apparatus includes a linked-up head having a plurality of short chips arranged in a staggered arrangement in the width direction of the recording medium. The rotational bodies for holding the floating of the recording medium on the downstream side of the linked-up head in the conveying direction are arranged in the width direction of the recording medium within a range of the short chip that ejected ink earlier on the recording medium.

11 Claims, 12 Drawing Sheets

INKJET RECORDING APPARATUS

BACKGROUND OF THE INVENTION

1. Field of the Invention

The present invention relates to an inkjet recording apparatus including a recording head composed of a plurality of short chips arranged in the width direction of a recording medium and a rotational body for regulating the distance between the recording head and the recording medium by holding the recording medium.

2. Description of the Related Art

In general, a recording apparatus having functions of a printer, a copying machine, and a facsimile machine is configured to form images (including characters and symbols) on a recording medium, such as paper, cloth, a plastic sheet, an OHP sheet, and an envelope, based on image information. A scanning system of the recording apparatus includes serial and line types. In the serial type, images are recorded by alternately repeating main scanning that moves the recording head along the recording medium and sub scanning that feeds the recording medium at a predetermined pitch. In the line type, while one line along a direction perpendicular to the conveying direction of the recording medium (the width direction of the recording medium) being correctively recorded, images are recorded only by conveying the recoding medium (sub scanning). The recording apparatus may be classified according to the recording system into an inkjet system, a thermal transfer system, a laser beam system, a heat sensitive system, and a wire dot system.

The line-type inkjet system recording apparatus (inkjet recording apparatus) may include a long recording head (may be called as a linked-up head) configured by arranging a plurality of short chips, each having a plurality of ink nozzles, in the width direction of a recording medium. In the linked-up head, the short chips are arranged so that nozzle trains are in parallel with the width of the recording medium and so that a plurality of the nozzles covers the entire recording medium in the width direction. The linked-up head ejects ink from the nozzles of the short chips for recording on the recording medium conveyed in a direction intersecting with the arranging direction of the short chips. Such a recording apparatus may also be called a full multiple printer.

FIG. 10 is a plan view showing a schematic configuration of the linked-up head elongated by linking the short chips together. FIGS. 11A and 11B are front views showing nozzle arrangement of the adjoining short chips in the linked-up head, wherein FIG. 11A shows the arrangement of the short chips where the nozzles at the end portion of each short chip overlap with those of the adjoining short chip in the conveying direction of the recording medium; FIG. 11B shows the arrangement of the short chips where the nozzles at the end portion of each short chip do not overlap with those of the adjoining short chip in the conveying direction of the recording medium. A short chip 61 herein includes a head chip with a length of about 0.2 to 1.0 inch and having 128 to 1256 nozzles arranged in a line. The nozzle density (resolution) of this case is equivalent to 1200 dpi. By alternately arranging a plurality of the head chips 61 so that adjoining ends of each head chip overlap with each other in the conveying direction of the recording medium, a linked-up head 1 with a desired size (desired length) is configured. A recording apparatus including such a long head is designated for high speed recording in comparison with a general serial recording apparatus.

FIG. 12 is a schematic view showing the recording operation of the serial recording apparatus; FIG. 13 a schematic view showing the recording operation of the full multiple recording apparatus including the linked-up head. In the serial recording apparatus, as shown in FIG. 12, while a head 101 being moved (scanned) relative to a recording medium 51 in a direction intersecting with the conveying direction of the recording medium 51, images are formed. Whereas, in the full multiple recording apparatus, as shown in FIG. 13, while the head 1 is fixed at a predetermined position, images are formed on the recording medium 51 conveyed in a direction intersecting with the arranging direction of a plurality of nozzles 62 of the head.

A conveying unit for conveying the recording medium in the full multiple recording apparatus includes an electrostatic absorption-transportation belt type in that the recording medium is absorbed on a belt with an electrostatic force and an air suction conveying type in that the recording medium is conveyed by absorbing it with an air suction force. It is very important for forming high quality images to have a distance between the heat and the recording medium (also referred to a head recording medium distance below). Namely, with reducing head recording medium distance, the accuracy is improved in landing positions on the recording medium of ink droplets ejected from the head. Hence, an image forming section has been designed such that the head approaches the recording medium as close as possible by eliminating the floating up of the recording medium by providing a rotational body for holding down the recording medium on a conveying belt, such as a spur roller and a roller.

FIG. 14 is a plan view showing conventional arrangement of rotational bodies for holding down the recording medium. Referring to FIG. 14, rotational bodies 152, such as spur rollers or rollers, are arranged for holding down a recording medium 51 on a conveying belt on upstream and downstream sides of the linked-up head 1 in the conveying direction. By providing these rotational bodies, the apparatus is devised such that the linked-up head 1 is moved to the recording medium 51 as closer as possible so as to prevent the deterioration in recorded image quality. Such a rotational body has been used as means for preventing the floating up of a recording medium also in the serial type inkjet recording apparatus as disclosed in Japanese Patent Laid-Open No. H07-60966.

However, as shown in FIG. 14, the use of the spur roller or the roller 152 for holding down the recording medium 51 on the conveying belt causes a region having already-formed images of the recording medium to be pushed, so that the degradation, such as flaws and coming-off, may be generated on the recording medium. Also, in the serial recording apparatus, when the recording medium is held down with the spur roller, etc., the apparatus is devised to have a time difference between the present scanning and the next scanning in accordance with image information in the vicinity of the spur roller as shown in Japanese Patent Laid-Open No. H07-60966. This is for ensuring the sustainable state against the pushing with the spur roller by securing a sufficient ink drying time so that ink droplets are absorbed into the recording medium. Whereas, in the full multiple recording apparatus including the linked-up head, images are formed only by paper feeding principally for high speed recording while one line being correctively recorded, so that the countermeasure in the serial recording apparatus cannot be adopted.

SUMMARY OF THE INVENTION

The present invention is directed to an inkjet recording apparatus capable of stably maintaining image quality by preventing the degradation in image quality due to a rotational body for holding down a recording medium when the recording medium is recorded with a linked-up head. In addition to this, the present invention is directed to an inkjet recording apparatus capable of reducing the distance between the head and the rotational body or the distance between a head and a different-color head so as to miniaturize the entire apparatus.

According to one aspect of the present invention, an inkjet recording apparatus includes a recording head and at least one rotational body. The recording head includes a plurality of short chips, each having a plurality of ink nozzles, arranged in a direction intersecting with a conveying direction of a recording medium. The recording head is configured to record on the recording medium that is conveyed in the direction intersecting with the arranging direction of the short chips by ejecting ink from the nozzles of the short chips. The rotational body for holding the floating of the recording medium on the downstream side of the recording head in the conveying direction is arranged within a range of the short chip that ejected ink earlier on the recording medium.

According to the present invention, when images are recorded with a recording head, image degradation due to rotational bodies for holding a recording medium can be prevented so as to stably maintain image quality. In addition, the distance between the linked-up head and the rotational bodies or the distance between a head and the rotational bodies or between a head and a different-color head can be reduced, miniaturizing the entire apparatus.

Further features of the present invention will become apparent from the following description of exemplary embodiments with reference to the attached drawings.

BRIEF DESCRIPTION OF THE DRAWINGS

FIGS. 11A and 11B are front views showing nozzle arrangement of the adjoining short chips in the linked-up head, wherein FIG. 11A shows the arrangement of overlapping nozzles at end portions; FIG. 11B shows the arrangement of not overlapped nozzles.

DESCRIPTION OF THE EMBODIMENTS

Figure 1:
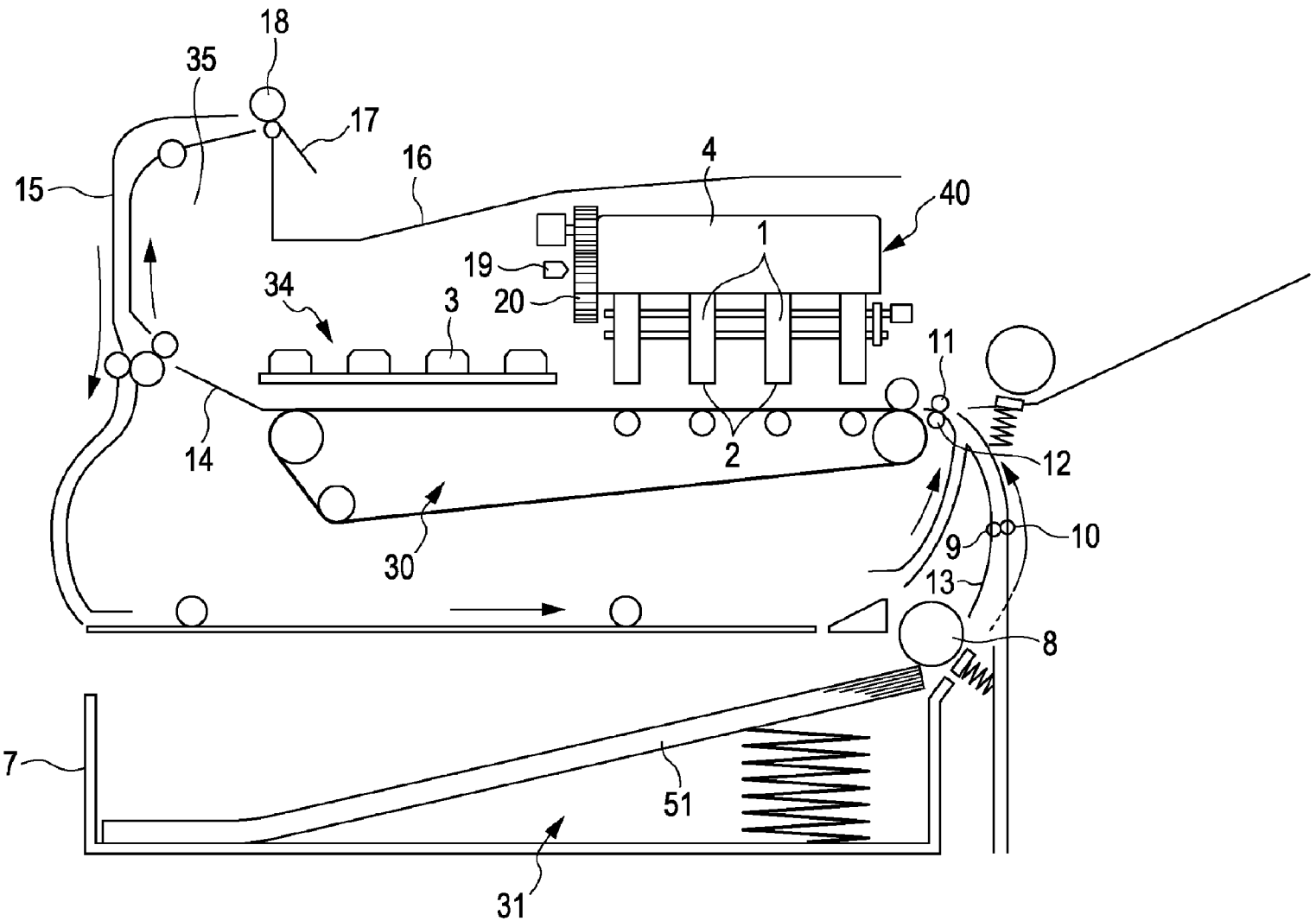
FIG. 1 is a longitudinal sectional view of an inkjet recording apparatus according to an embodiment of the present invention.

Embodiments of the present invention will be specifically described with reference to the drawings. In the drawings, like reference characters designate like correspondent components. FIG. 1 is a longitudinal sectional view of an inkjet recording apparatus according to an embodiment of the present invention. Referring to FIG. 1, reference numeral 7 denotes a paper feed cassette; numeral 8 a pickup roller; numerals 9 and 10 feed rollers; numerals 11 and 12 registration rollers; and numeral 13 a transport guide on the feed side. Also, numeral 14 denotes a transport guide for two-sided recording; numeral 15 a transport guide on the paper output side; numeral 16 a paper output tray; numeral 17 a paper output flag; numeral 18 a paper output roller; numeral 19 a sensor for detecting the coming up and down of a recording head; and numeral 20 a rack gear for raising and lowering the recording head.

The paper feed cassette 7 constitutes a paper feed section 31. Recording media 51, such as recording paper and OHP sheets, accommodated in the paper feed cassette 7 of the paper feed section 31 are separated on demand in every one medium by the pickup roller 8 and fed to a belt-type transport section 30. While the recording medium being conveyed through the transport section 30 with a belt transport mechanism including an endless belt, images are formed thereon by an image forming section 40, so that the recorded recording medium is conveyed to the tray 16 via a paper output section 35. According to the embodiment, an inkjet recording apparatus may also be adopted in that a recording medium is recorded while being conveyed along a fixed planar platen by a conveying roller. The recording apparatus shown in FIG. 1 is for color recording and the image forming section 40 includes four recording heads 1 held by head holders 4. The four recording heads 1 are constituted according to ink color by a black head 1BK, a cyan head 1C, a magenta head 1M, and a yellow head 1Y, for example.

The recording head 1 is a line type in that on a discharge surface 2, a plurality of (a large number of, for example) nozzles 62 are arranged over a range covering the width of a recording medium. The recording head 1 in the line type apparatus according to the embodiment is composed of a linked-up head configured by alternately arranging a plurality of short chips 61 so that end portions overlap with each other in a direction intersecting (perpendicular, for example) with the conveying direction of a recording medium 51. A cap unit 34 is for covering an ink discharge section of the recording head 1. The cap unit 34 includes four caps 3 for covering each nozzle of the discharge surface 2 of each recording head. The cap 3 has functions of reducing ink evaporation from the nozzle and of protecting the nozzle. FIG. 1 shows a recordable state, so that the cap unit 34 is evacuated from the image forming section 40 to a separation position in the left side of the drawing.

Figure 2:
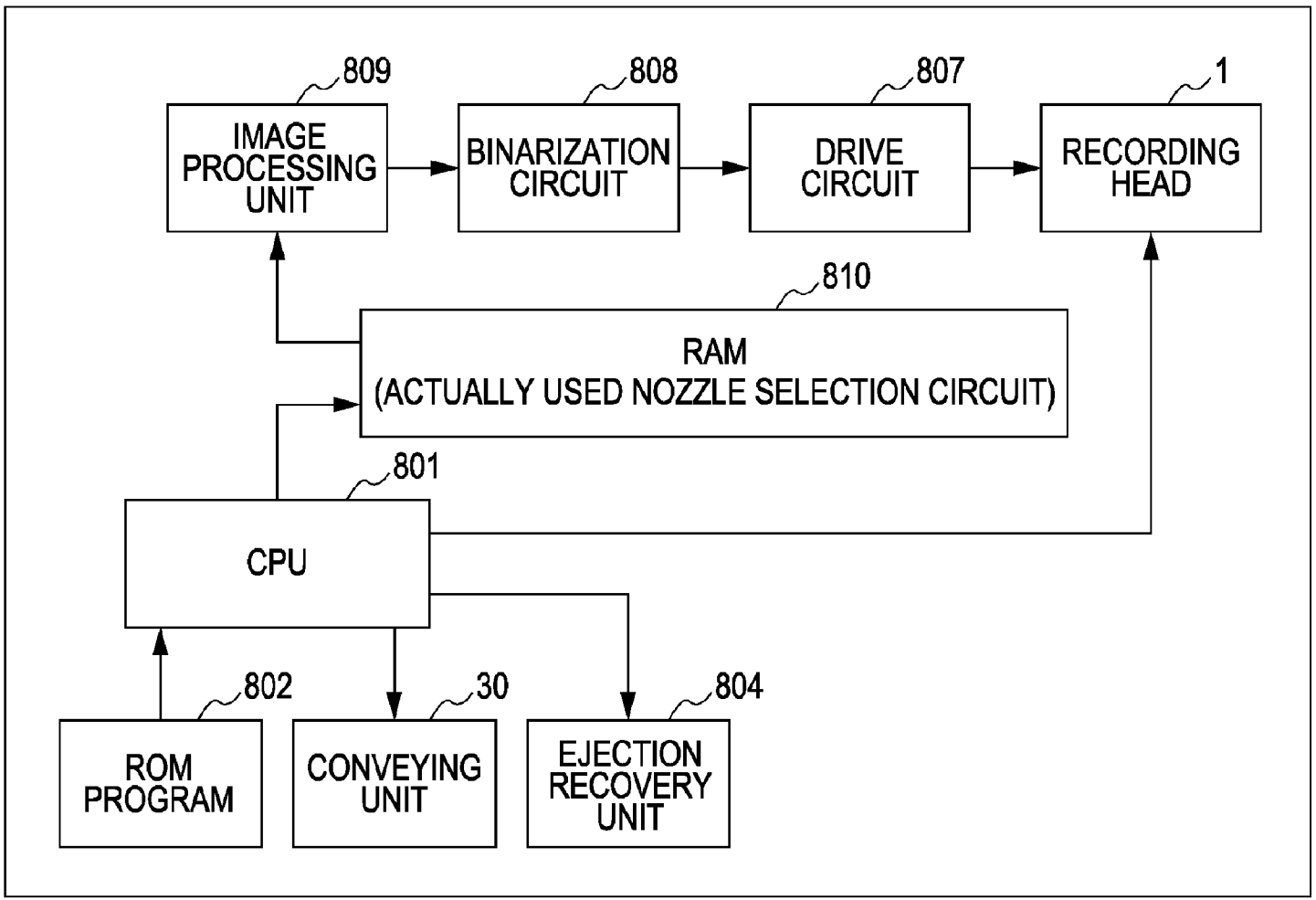
FIG. 2 is a block diagram of a system configuration of the inkjet recording apparatus according to the embodiment of the present invention.

FIG. 2 is a block diagram of a system configuration of the inkjet recording apparatus according to the embodiment of the present invention. Referring to FIG. 2, a CPU 801 controls the entire system; an ROM 802 includes a software program written therein for controlling the system; the transport section 30 conveys the recording medium 51 such as paper and an OHP film; a discharge recovery unit 804 recovers the ink discharge function of the recording head; and the recording head 1 is a line type recording head. According to the embodiment, the recording head 1 is the linked-up head composed of a plurality of the short chips 61 as described above. This linked-up head 1 is a full multiple inkjet recording head for recording on the recording medium 51 conveyed in a direction intersecting with the arranging direction of the head chips 61 by ejecting ink from the nozzles 62 of each short chip.

Referring to FIG. 2, a drive circuit 807 controls the ink ejection of the recording head 1; a binarization circuit 808 converts images to be recorded into ejection data (may also perform halftone processing); an image processing unit 809 processes color separation on color images to be recorded; an RAM 810 stores data required for controlling an ink ejection amount from the nozzles 62 in the linked-up portion of each head chip 61 of the recording head 1 according to the present invention. The RAM 810 includes a circuit for selecting a nozzle for use in ink ejecting among a plurality of nozzles based on an image signal.

Figure 3:
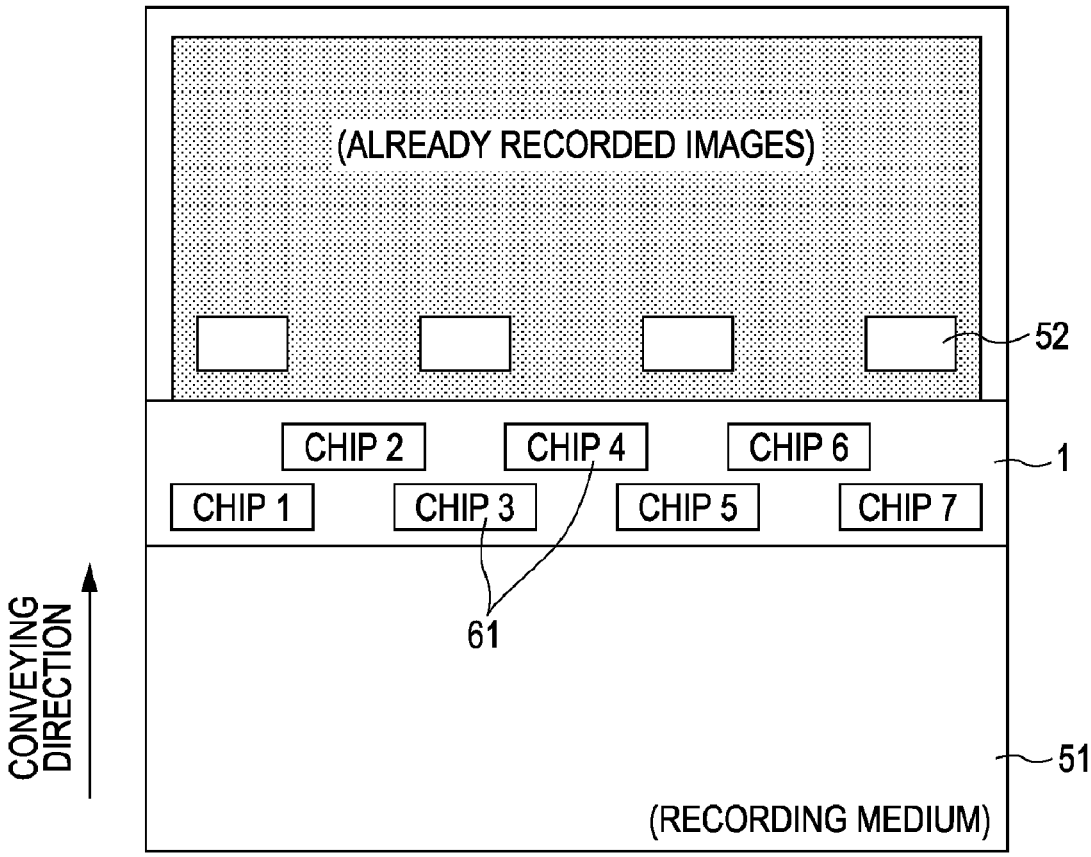
FIG. 3 is a plan view of an image forming section of an inkjet recording apparatus including one linked-up head according to a first embodiment of the present invention.

FIG. 3 is a plan view of an image forming section of an inkjet recording apparatus including one linked-up head according to a first embodiment incorporating the invention. FIG. 3 shows the arrangement of rotational bodies (spur rollers or rollers) 52 especially in one linked-up head. As shown in FIG. 3, the linked-up head 1 is configured by tying up the seven short chips 61 (chips 1 to 7) in staggered arrangement (so as to be alternately arranged fore and aft in the conveying direction as shown in the drawing, for example). According to the embodiment, as shown in the drawing, the short chips are arranged so that adjoining ends of each short chip overlap with each other in the conveying direction. However, the nozzles themselves of adjoining short chips do not necessarily overlap in the conveying direction. As apparent from the conveying direction shown in FIG. 3, odd-numbered short chips 1, 3, 5, and 7 are arranged on the upstream side in the conveying direction in comparison with even-numbered short chips 2, 4, and 6. On the conveyed recording medium 51, ink droplets ejected from the odd-numbered short chips 1, 3, 5, and 7 are landed earlier than those from the even-numbered short chips 2, 4, and 6.

Therefore, ink droplets ejected from the odd-numbered chips of the linked-up head 1 are absorbed and permeated in the recording medium before those ejected from the even-numbered chips are absorbed and permeated therein. By such a situation, in the downstream side region of the recording medium from the linked-up head, it is advantageous to arrange the rotational bodies 52 for holding the recording medium, such as spur rollers or rollers, within ranges of ink ejection sections (nozzle trains) of the odd-numbered chips 1, 3, 5, and 7 arranged along the width direction of the recording medium. Then, according to the embodiment, in the downstream side of the linked-up head 1 in the conveying direction, the rotational bodies 52 for holding the floating of the recording medium 51 are arranged within ranges of the short chips 61 located where ink is ejected earlier on the recording medium in its width direction. The short chips 61 located where ink is ejected earlier on the recording medium herein according to the embodiment, as apparent from FIG. 3, are the odd-numbered chips 1, 3, 5, and 7. The rotational bodies 52 come in contact with regions of the recording medium recorded by ink ejected from the nozzles of the odd-numbered chips 1, 3, 5, and 7.

On the other hand, in the upstream side of the linked-up head in the conveying direction, since images are not yet formed at this position, the rotational bodies can be arranged at positions close to the linked-up head as possible in structure only for preventing the floating of the recording medium. By such arrangement of the rotational bodies according to the first embodiment, a desired distance between the head and the recording medium can be maintained without leaving flaws on the just recorded recording medium. That is, the degradation of images due to the rotational bodies for holding the recording medium can be prevented so as to stably maintain image quality. In addition, the distance between the linked-up head and the rotational bodies can be reduced, miniaturizing the entire apparatus.

Figure 4:
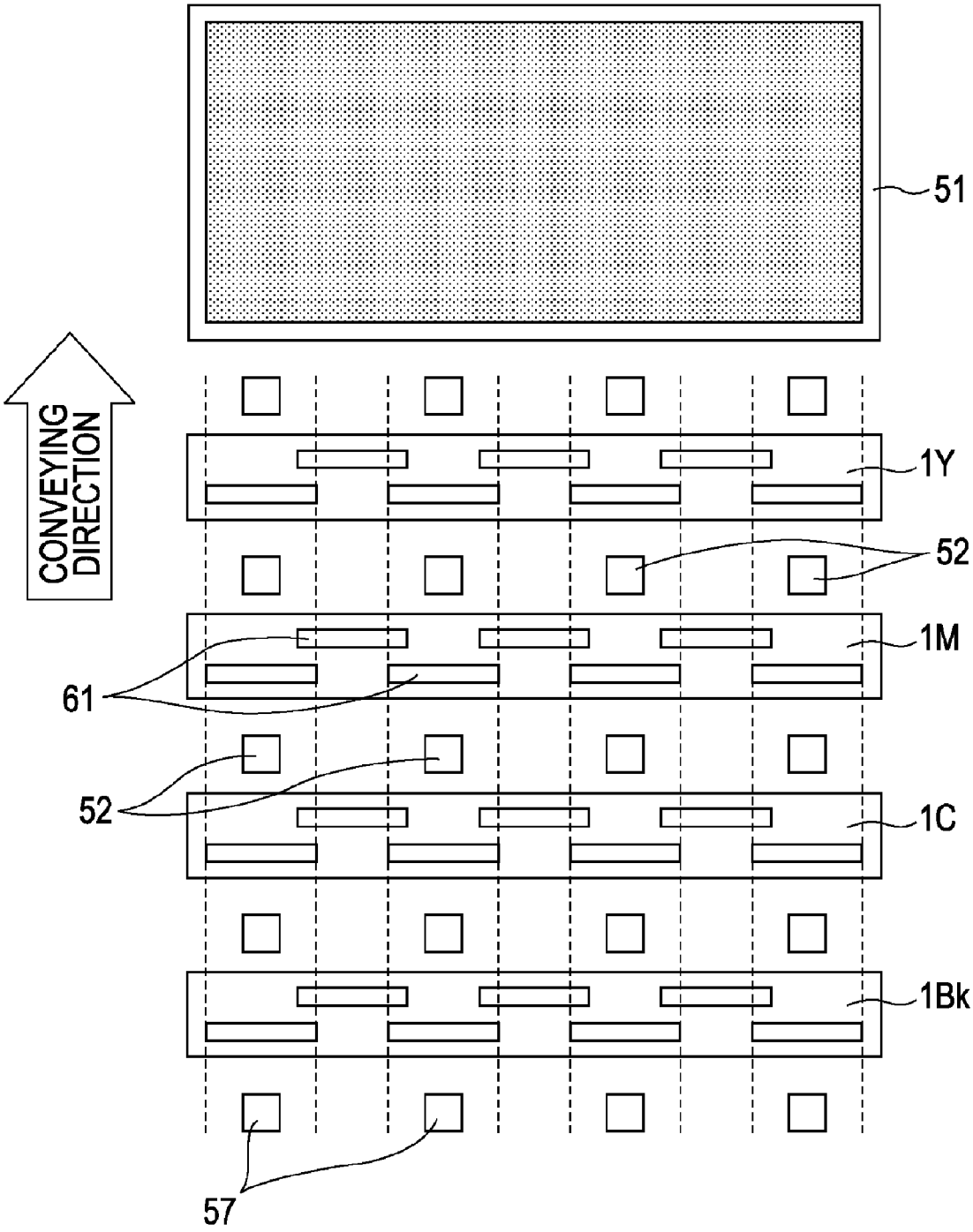
FIG. 4 is a plan view of a modified image forming section of an inkjet recording apparatus including a plurality of the linked-up heads (four heads in the drawing) like in a color recording apparatus, showing arrangement of rotational bodies according to the first embodiment shown in FIG. 2.
Figure 5:
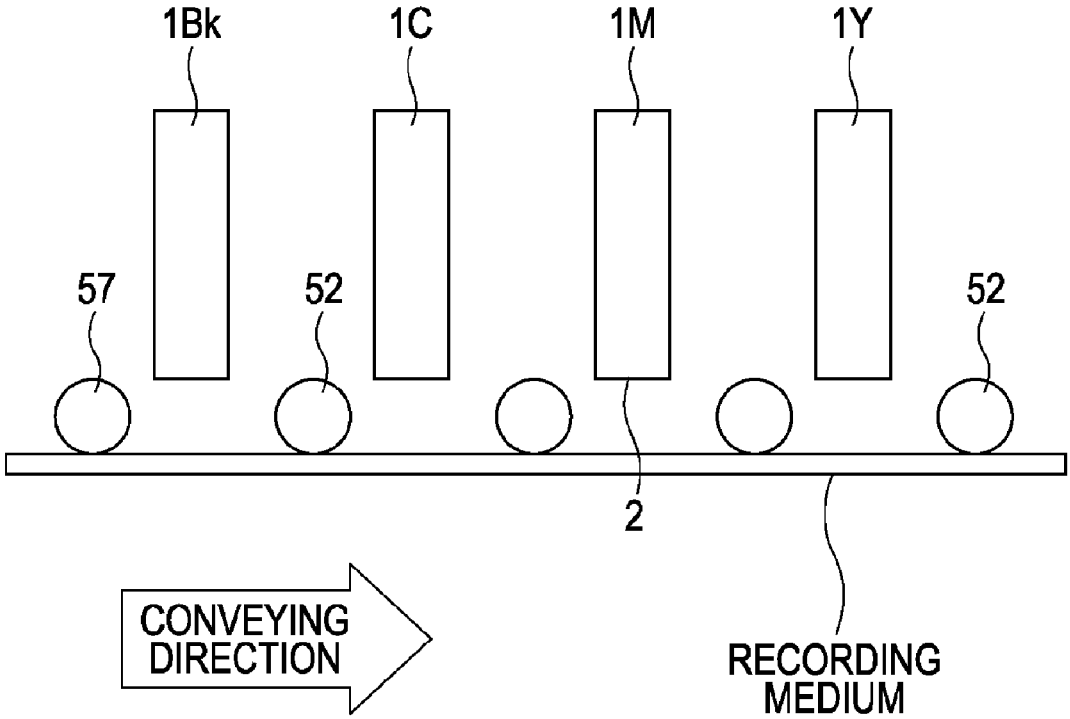
FIG. 5 is a side view of the image forming section shown in FIG. 4.

FIG. 4 is a plan view of a modified image forming section of an inkjet recording apparatus including a plurality of the linked-up heads (four heads) like in a color recording apparatus shown in FIG. 1, showing arrangement of rotational bodies according to the first embodiment shown in FIG. 3. FIG. 5 is a side view of the image forming section shown in FIG. 4. Referring to FIGS. 4 and 5, in the image forming section, the four linked-up heads 1BK, 1C, 1M, and 1Y ejecting different inks are arranged. In the drawings, black (BK), cyan (C), magenta (M), and yellow (Y) are arranged in that order from the upstream side in the conveying direction. Referring to FIG. 4, all the rotational bodies 52 arranged between the linked-up heads 1 are arranged within ranges of ink ejection regions of the odd-numbered chips ejecting ink droplets earlier than those ejected from the even-numbered chips according to the case of FIG. 3. However, according to the embodiment, for a rotational body 57 arranged on the upstream side of the black linked-up head 1BK on the most upstream side (on the left side of 1BK in FIG. 5), since it holds a portion where images are not yet formed, it is not required to limit its arranging position and the arranging range.

Figure 6:
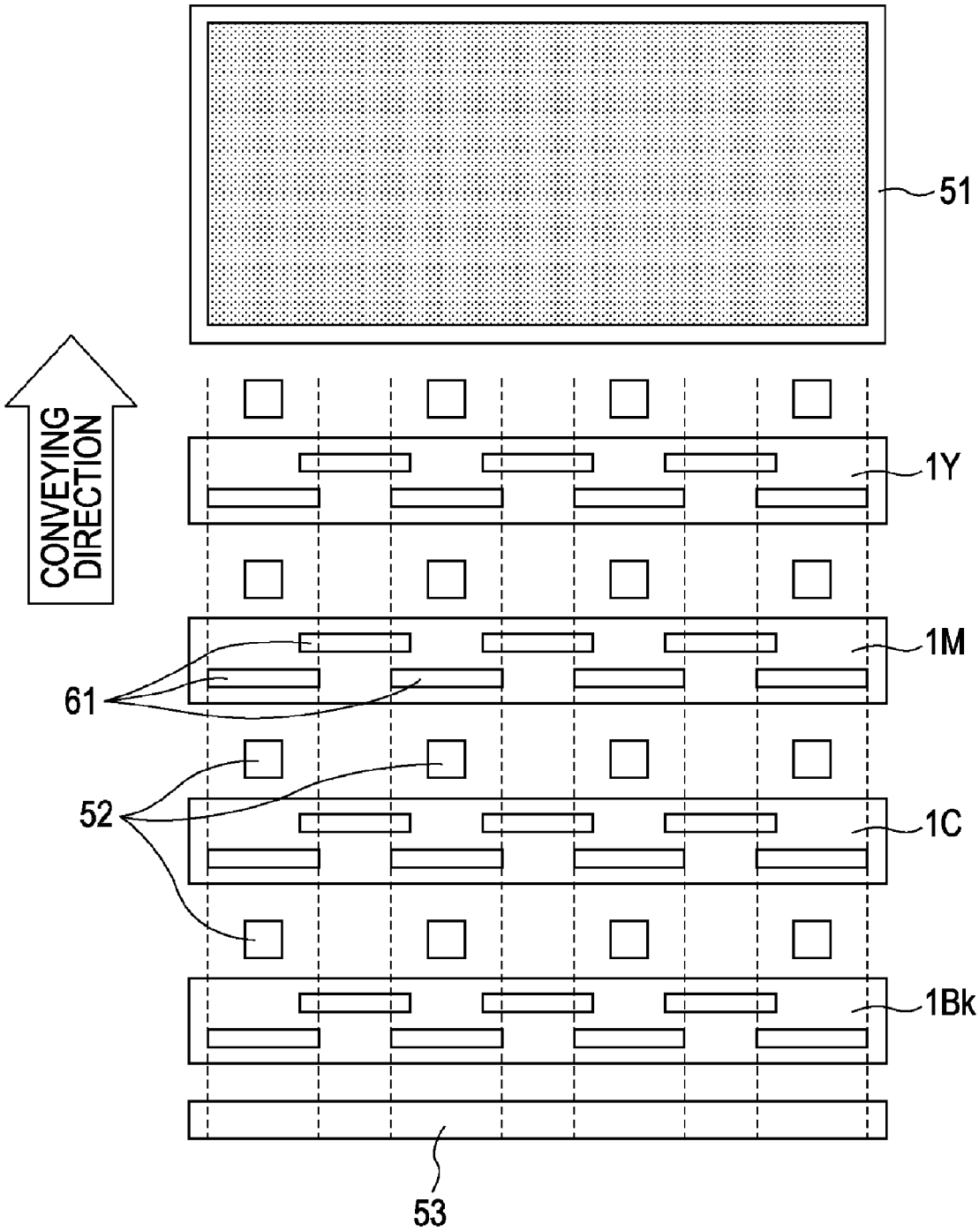
FIG. 6 is a plan view of the image forming section showing a partially modified arrangement of the rotational bodies according to the first embodiment shown in FIG. 4.

FIG. 6 is a plan view of the image forming section showing a partially modified arrangement of the rotational bodies according to the first embodiment shown in FIG. 4. In this modification, rotational bodies arranged on the upstream side of the black linked-up head 1BK on the most upstream side are integrated into one long rotational body (roller or spur roller) 53, and other configurations are substantially the same as those of FIG. 4. This is because images are not yet formed on portions on the upstream side of the linked-up head on the most upstream side, so that the arrangement position and the range of the rotational body are not limited and the integration has no problem.

The distance between each linked-up head 1 and the rotational bodies 52 in the conveying direction of the recording medium is selected to strike a balance between the ink droplet drying time and the fairly controllable length of the recording medium. That is, a distance is selected to have a balance between the ensuring time for sufficiently drying ink droplets within a physically possible range and the maintaining desired distance between the head and the recording medium by securely holding the recording medium at a position close to the head. On the other hand, the distance between the rotational bodies 52 (or 53, 57) and the subsequent head, such as the distance the rotational bodies 52 between the head 1BK and the head 1C shown in FIG. 4 and the head 1C, is desirable to be as small as possible. These mutual distances are determined in consideration of the physical arrangement of each head and the ink drying time determined by the relationship between used ink and the recording medium in the designing the recording apparatus. In this case, the distances are determined based on the ink drying time in that images cannot be deteriorated even when held by the spur roller in practice.

The embodiment described above relates to the recording apparatus having the recording head 1 configured by arranging a plurality of the short chips 61, each having a plurality of ink nozzles, in a direction intersecting with the conveying direction of the recording medium 51. In particular, the embodiment is intended for the inkjet recording apparatus in that on a recording medium conveyed in a direction intersecting with the arranging direction of short chips, images are recorded by ejecting ink from the nozzles 62 of each short chip. Then, for holding the floating of the recording medium on the downstream side of the recording head in the conveying direction, the rotational bodies 52, such as spur rollers and rollers, are arranged in the width direction of the recording medium within ranges of the short chips located at positions where ink is ejected earlier on the recording medium. In the configuration mentioned above, the short chips located at positions where ink is ejected earlier on the recording medium, as shown in the drawing, for example, are chips located on the upstream side in the conveying direction (the odd-numbered chips 1, 3, 5, and 7 shown in FIG. 3, for example) among a plurality of staggered chips (arranged alternately) as shown in the drawing.

According to such an embodiment, when images are recorded with the linked-up head, the image degradation, such as flaws and coming-off, due to the rotational bodies for holding the recording medium can be prevented so as to stably maintain image quality. In addition, the distance between the linked-up head and the rotational bodies or the distance between a head and a different-color head can be reduced, miniaturizing the entire apparatus.

Figure 7:
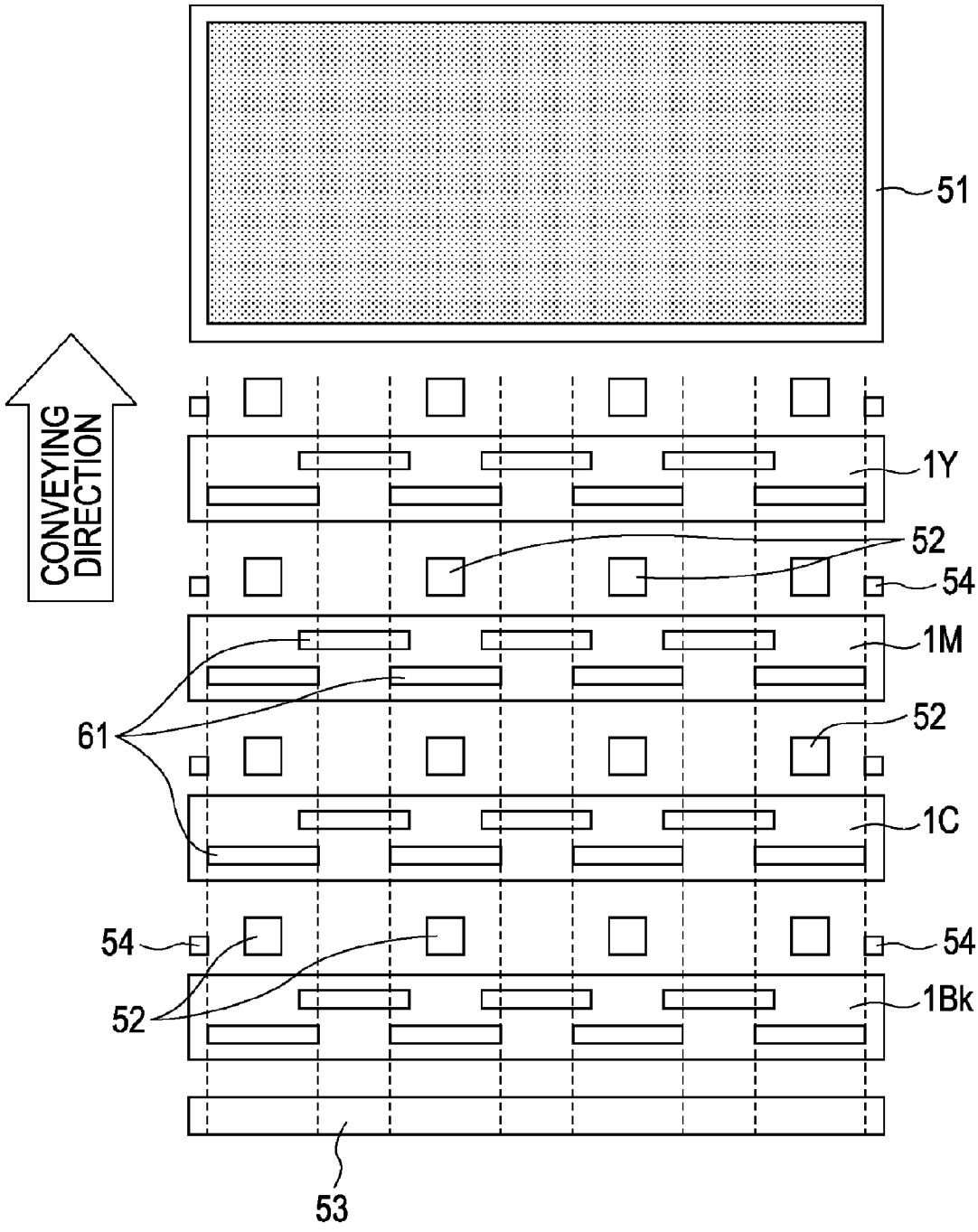
FIG. 7 is a plan view of an image forming section of an inkjet recording apparatus according to a second embodiment of the present invention showing the arrangement of the rotational bodies.
Figure 8:
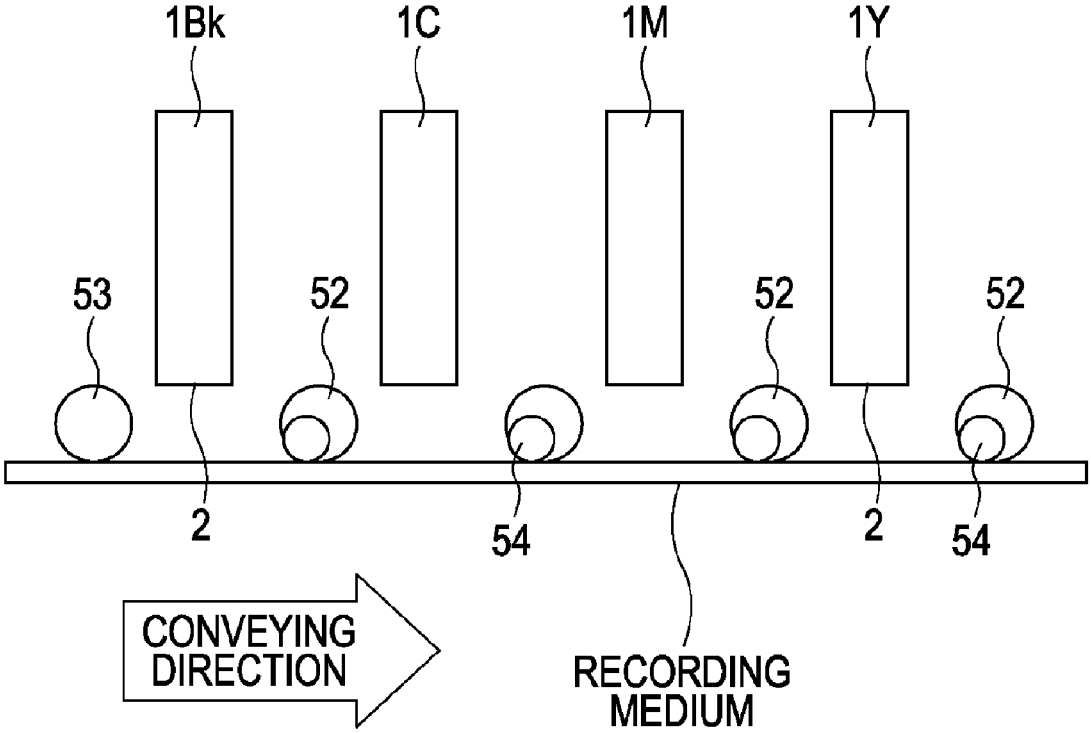
FIG. 8 is a side view of the image forming section shown in FIG. 7.

FIG. 7 is a plan view of an image forming section of an inkjet recording apparatus according to a second embodiment of the present invention showing the arrangement of the rotational bodies. FIG. 8 is a side view of the image forming section shown in FIG. 7. According to the second embodiment, rotational bodies 54 for holding edges of the recording medium 51 are added to the arrangement of the rotational bodies 52 and 53 according to the first embodiment shown in FIG. 6. According to the embodiment, reference numeral 52 denotes rotational bodies located between the heads 1BK, 1C, 1M, and 1Y shown in FIG. 6, and numeral 53 denotes the integrated rotational body 53 located on the upstream side of the head 1BK. In FIGS. 7 and 8, the rotational bodies 52 and 53 are the same as those according to the first embodiment. On the other hand, the rotational bodies 54, such as rollers and spur rollers, located at edges are for holding non-recording portions at edges of the recording medium 51. In the configuration in the drawing, the rotational bodies 54 at edges are arranged so as to hold edges of the recording medium at positions on the downstream side of each linked-up head (each recording head) 1 in the conveying direction. However, the arrangement of the individual rotational bodies 54 at edges is not especially limited as long as they can hold the floating of the edges.

The second embodiment shown in FIGS. 7 and 8 has substantially the same configuration as that of the first embodiment (especially the modification shown FIG. 6) other than the point described above. Hence, the same effect as that of the first embodiment can be obtained. Furthermore, the second embodiment is effective for outputting the full page printing in that images are finally recorded on the whole area of the recording medium. That is, when the width of the recording medium is increased larger than that of the recordable head region so as to provide overlap-width portions at edges, images are recorded on the whole area in a state of the overlap-width portions held by the rotational bodies 54, and then, the overlap-width portions are finally cut off, so that the full page printing can be outputted. Also, the second embodiment is no concern with the number of the linked-up heads (recording heads) 1, so that the case where the number of the linked-up heads is one or arbitrary plural may be similarly incorporated in the embodiment.

Figure 9:
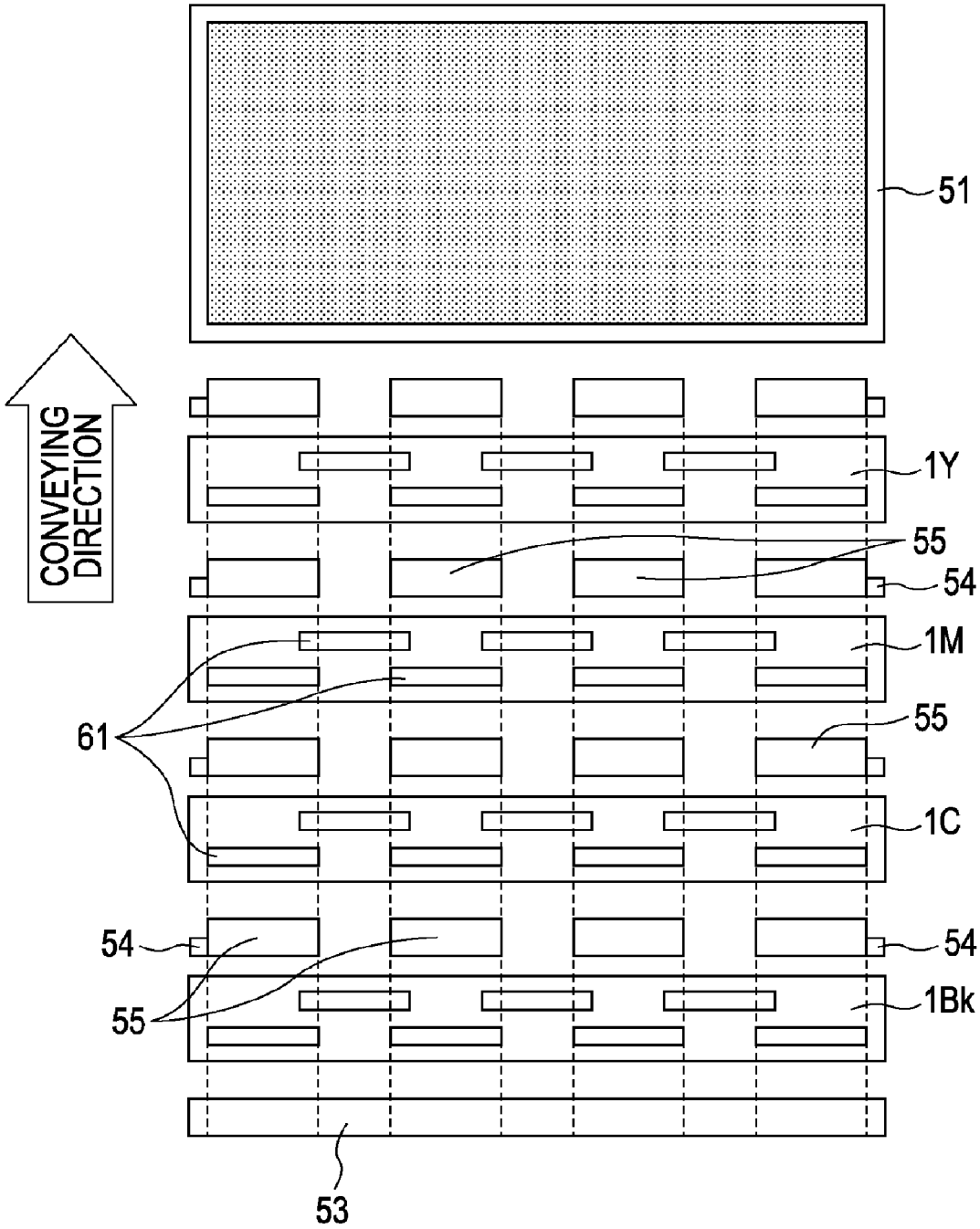
FIG. 9 is a plan view of an image forming section of an inkjet recording apparatus according to a third embodiment of the present invention showing the arrangement of the rotational bodies.
Figure 10:
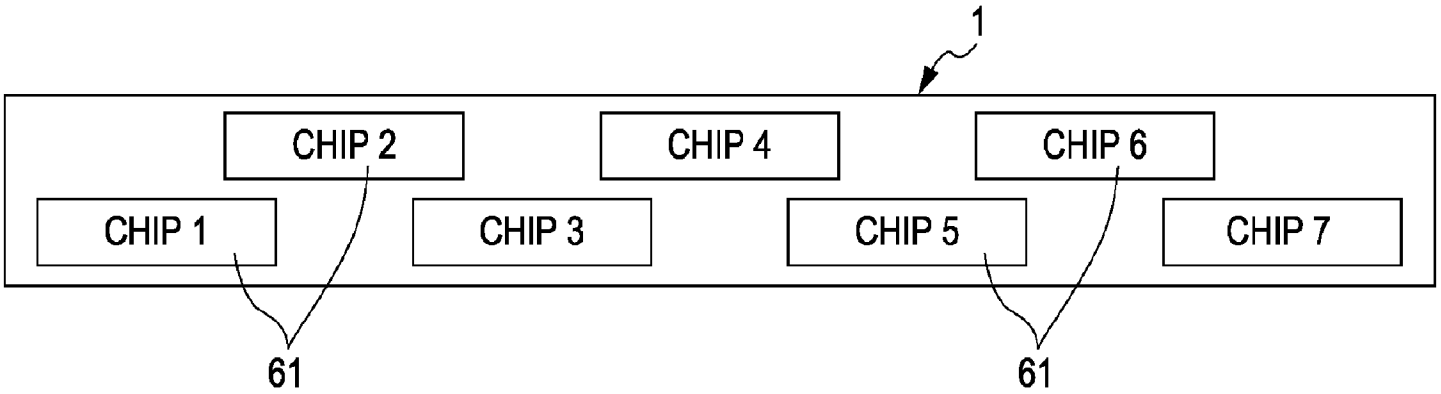
FIG. 10 is a plan view showing a general schematic configuration of the linked-up head elongated by tying up short chips.
Figure 11A:
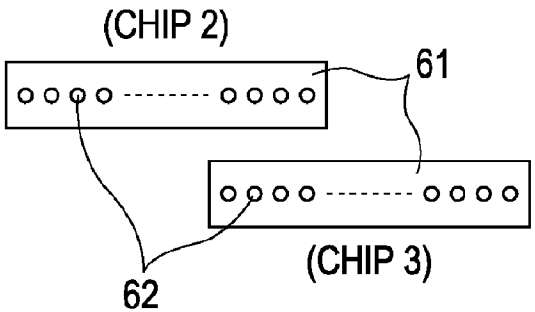
FIG. 11A PRIOR ART
Figure 11B:
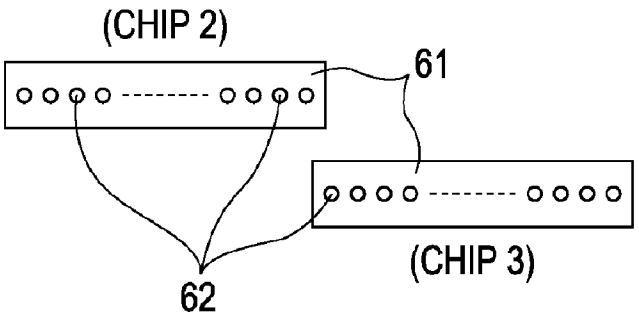
FIG. 11B PRIOR ART
Figure 12:
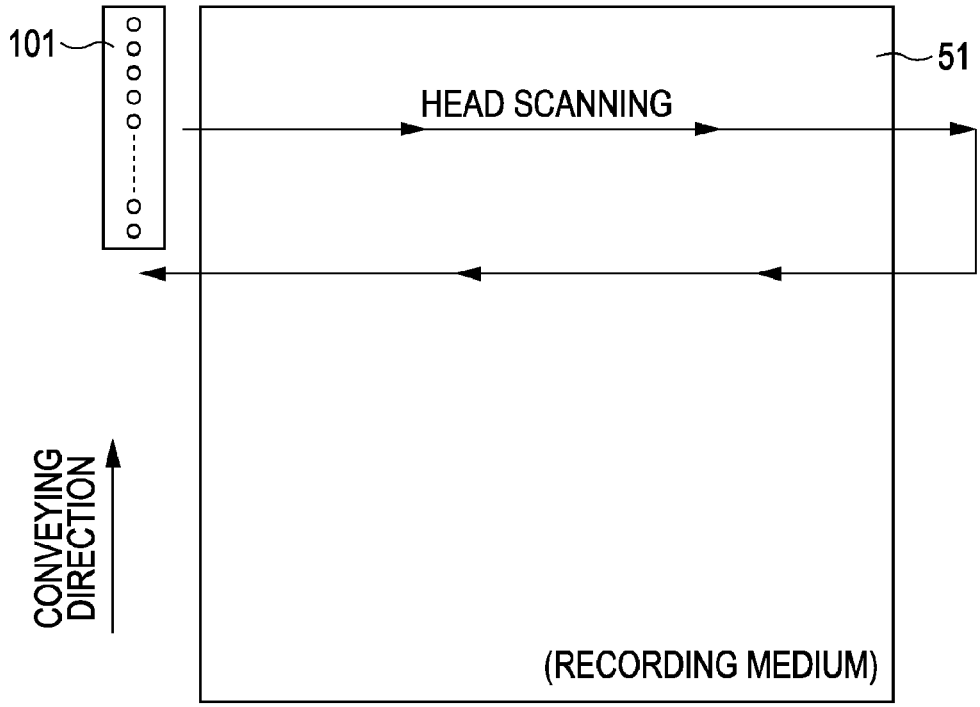
FIG. 12 PRIOR ART
FIG. 12 is a schematic view showing the recording operation in a serial recording apparatus.
Figure 13:
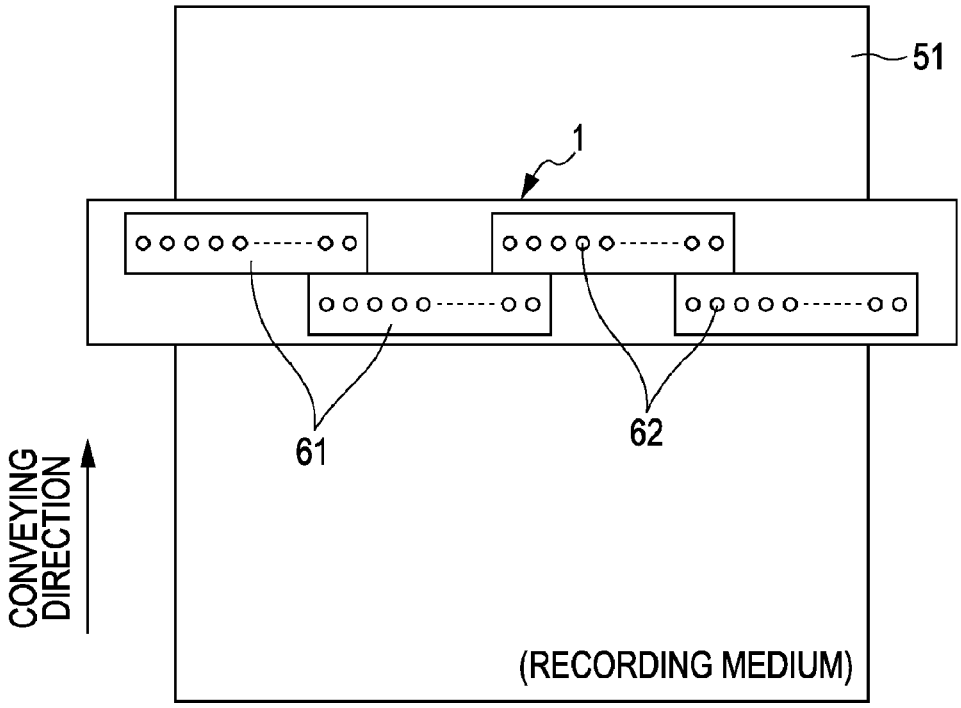
FIG. 13 PRIOR ART
FIG. 13 is a schematic view showing the recording operation in a full multiple recording apparatus including the linked-up head.
Figure 14:
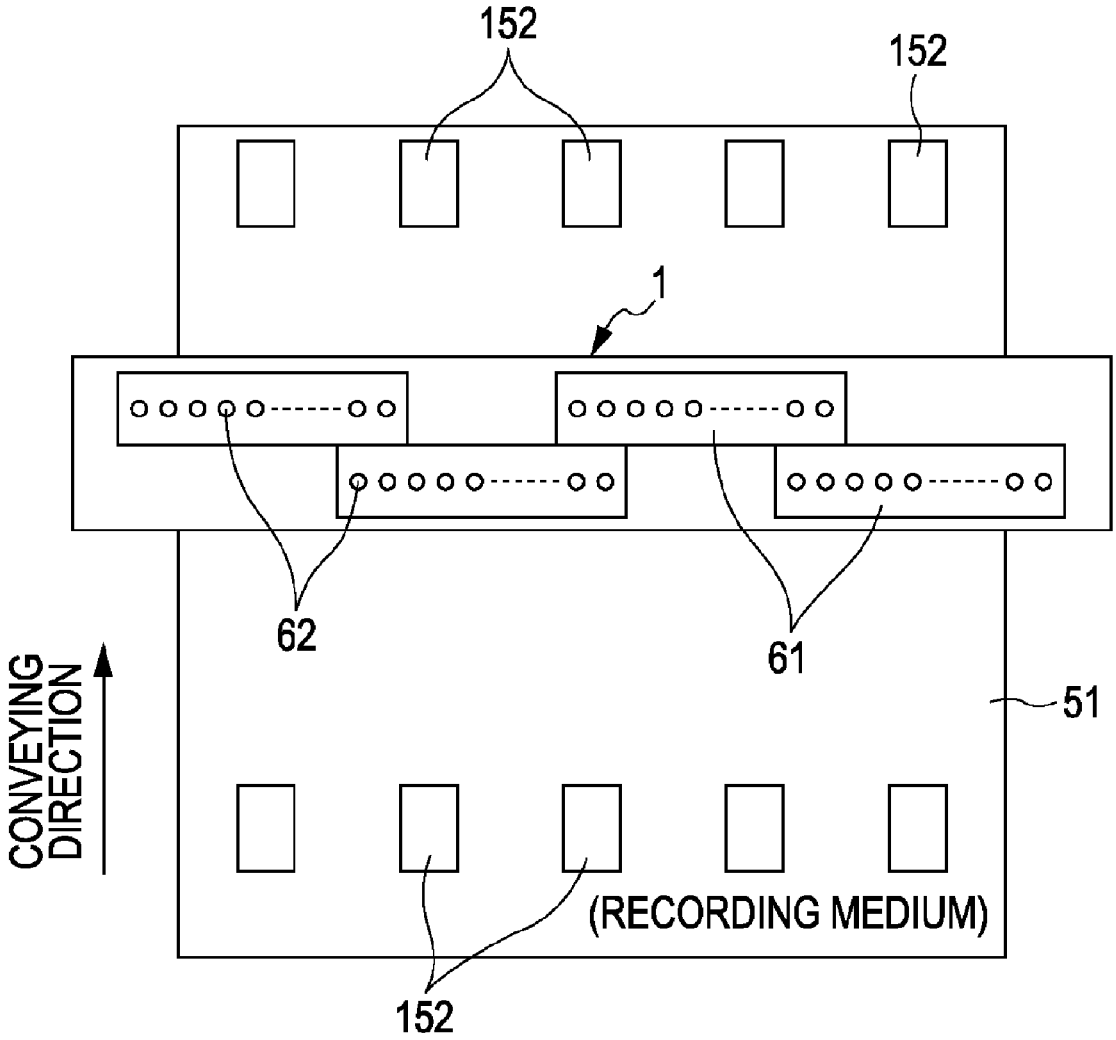
FIG. 14 PRIOR ART
FIG. 14 is a plan view showing conventional arrangement of the rotational bodies for holding down the recording medium.

FIG. 9 is a plan view of an image forming section of an inkjet recording apparatus according to a third embodiment of the present invention showing the arrangement of the rotational bodies. According to the third embodiment, the short chip 61 are arranged so that one or a plurality of nozzles at an end portion of each short chip overlap in the conveying direction with those of the adjoining short chip (see FIG. 11A). The purpose for arranging nozzles at an end portion of each short chip to be overlapping in the conveying direction with those of the adjoining short chip in such a manner is to prevent images formed with the linked-up head from being deteriorated at the end portion of each short chip. The image deterioration in this case includes streak generation in that images formed at the linked-up portion are alternately thicken and faded, for example. Then, when the nozzles of the short chips adjacent to each other overlap with each other in the conveying direction, a method is disclosed in Japanese Patent Publication No. 2980429, in which nozzles of one chip are not used but nozzles of both chips are alternately used or are used by allocating frequency of usage.

In the portion of the recording medium recorded by such an overlapped nozzle portion (referred to also as a linked-up portion below), the time difference is generated in landed ink droplets. Thus, it is advantageous for the point that ink is earlier absorbed in the overlapped portion in comparison with the case where ink droplets are landed at a time from a non-overlapped nozzle portion (nozzles in an intermediate portion of a short chip, referred to also as a non-linked-up portion below). As a result, ink on the recording medium is faster (earlier) dried in the overlapped portion. Then, according to the third embodiment including short chips having overlapping nozzles, as shown in FIG. 9, rotational bodies 55 are arranged to hold even an image portion formed by the linked-up portion of the head.

Namely, the rotational bodies 55 are arranged in the width direction of the recording medium, up to the range where nozzles of adjoining short chips overlap in addition to the range of the short chips located at positions ejecting ink earlier. The rotational bodies 55 in this case are also made of spur rollers and rollers. The linked-up portion of the linked-up head 1 indicates the portion where nozzles of adjoining short chips overlap as mentioned above. The configuration of the third embodiment other than the point described above is substantially the same as that of the second embodiment shown in FIGS. 7 and 8. FIG. 9 shows the third embodiment incorporated in the inkjet recording apparatus including four linked-up heads. The third embodiment is also no concern with the number of the linked-up heads 1, so that even one linked-up head may be similarly incorporated in the embodiment in the same way as in the first and second embodiments.

According to the third embodiment, in comparison with the first and second embodiments, the distance between the head and the recording medium can be controlled more precisely by additionally providing the holding region with the rotational body by the linked-up portion (the portion where nozzles overlap). However, when the distance between the head and the recording medium can be sufficiently controlled without holding even the linked-up portion, the rotational bodies should be arranged within the non-linked-up regions (non-overlapped nozzles regions) of the odd-numbered short chips, as in the first and second embodiments. Also, according to the third embodiment described above, the same effect as that of the second embodiment can be obtained.

The inkjet recording apparatus according to the present invention is not limited to a single apparatus such as a printer, a copying machine, a facsimile machine, and an image forming apparatus. The present invention may be widely incorporated in a recording apparatus in a combined apparatus combined with these apparatuses or with a computer system. Also, the recording medium may include any recordable substances, such as paper, cloth, a plastic sheet, an OHP sheet, and an envelope, independently of materials and shapes.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-167281 filed Jun. 16, 2006, which is hereby incorporated by reference herein in its entirety.

What is claimed is:

1. An inkjet recording apparatus comprising:

a recording head including a plurality of short chips, each having a plurality of ink nozzles, configured to eject the same kind of the ink, the short chips being arranged in a direction intersecting with a conveying direction of a recording medium, the recording head being configured to record on the recording medium that is conveyed in the conveying direction ejecting ink from the nozzles of the short chips; and at least one rotational body arranged adjacent to the recording head on the downstream side in the conveying direction, wherein the short chips comprise a first chip and a second chip arranged on the downstream of the first chip in the conveying direction, and the nozzles of the first chip eject ink on a first region of a surface of the recording medium earlier than the nozzles of the second chip eject ink on the second region of the surface of the recording medium, and wherein the rotational body is arranged at a position where the rotational body contacts the first region of the surface of the recording medium and the rotational body does not contact the second region of the surface of the recording medium.

2. The apparatus according to claim 1, wherein the rotational bodies are arranged so as to hold the edges of the recording medium.

3. The apparatus according to claim 1, wherein the rotational body is arranged substantially close to the recording head on the downstream side of the rotational body in the conveying direction.

4. The apparatus according to claim 1, wherein in the recording head, the short chips are alternately arranged so that the end portions of adjoining short chips overlap with each other in the conveying direction of the recording medium.

5. A recording apparatus comprising:

a conveying unit configured to convey a recording medium in a conveying direction;

a recording head having a plurality of head chips, each having a plurality of nozzles, configured to eject the same kind of liquid droplets from the nozzles of each of the head chips; and a contact member arranged adjacent to the recording head on the downstream side in the conveying direction so as to contact with the recorded surface of the recording medium on which the nozzles eject the liquid, wherein the contact member is arranged at a position where the contact member does not overlap in the conveying direction with the head chip, which is arranged on the most downstream side in the conveying direction among the plurality of head chips ejecting the same kind of liquid droplets wherein the head chips comprise a first chip and a second chip arranged on the downstream of the first chip in the conveying direction, the nozzles of the first chip eject ink on a first region of a surface of the recording medium earlier than the nozzles of the second chip eject ink on the second region of the surface of the recording medium, and wherein the contact member is arranged at a position where the contact member contacts the first region of the surface of the recording medium and the contact member does not contact the second region of the surface of the recording medium.

6. The recording apparatus according to claim 5, wherein a plurality of the contact members are provided, and among the plurality of the contact members, the contact member arranged on the most upstream side in the conveying direction is arranged at a position where this contact member does not overlap in the conveying direction with the head chip arranged on the most downstream side.

7. The recording apparatus according to claim 5, wherein in the recording head, the head chips are alternately arranged so that the end portions of adjoining head chips overlap with each other in the conveying direction of the recording medium.

8. The recording apparatus according to claim 5, wherein the head chips are arranged so that one or a plurality of the nozzles of adjoining head chip ends overlap with each other in the conveying direction.

9. The recording apparatus according to claim 5, wherein the head chips are arranged so that the nozzles of adjoining head chips do not overlap with each other in the conveying direction.

10. The recording apparatus according to claim 5, wherein among the plurality of head chips, the head chips with both ends adjoining the other head chips are arranged so that the both ends overlap with ends of the other head chips on the downstream side or the upstream side in the conveying direction.

11. The recording apparatus according to claim 5, wherein the contact member includes a rotational body rotatable in contact with the recording medium.

* * * * *